US007983438B2

(12) United States Patent
Tsunoda

(10) Patent No.: US 7,983,438 B2
(45) Date of Patent: Jul. 19, 2011

(54) HEADPHONE DEVICE

(75) Inventor: Naotaka Tsunoda, Tokyo (JP)

(73) Assignee: Sony Corporation, Tokyo (JP)

( * ) Notice: Subject to any disclaimer, the term of this patent is extended or adjusted under 35 U.S.C. 154(b) by 695 days.

(21) Appl. No.: 10/560,892

(22) PCT Filed: Apr. 14, 2005

(86) PCT No.: PCT/JP2005/007579

§ 371 (c)(1),
(2), (4) Date: Apr. 26, 2006

(87) PCT Pub. No.: WO2005/101895

PCT Pub. Date: Oct. 27, 2005

(65) Prior Publication Data

US 2006/0188121 A1 Aug. 24, 2006

(30) Foreign Application Priority Data

Apr. 16, 2004 (JP) ..... 2004-121918

(51) Int. Cl.
*H04R 25/00* (2006.01)

(52) U.S. Cl. ..... 381/371; 381/370; 381/373

(58) Field of Classification Search ..... 381/386, 381/353–354, 370–384, 71.6, 309; 181/129, 181/284–294

See application file for complete search history.

(56) References Cited

U.S. PATENT DOCUMENTS

| | | | | | |
|---|---|---|---|---|---|
| 2,468,721 | A * | 4/1949 | Volkmann | 181/129 |
| 3,112,005 | A * | 11/1963 | Shaw et al. | 181/129 |
| 3,220,505 | A * | 11/1965 | Hargrave | 181/129 |
| 4,041,256 | A * | 8/1977 | Ohta et al. | 381/373 |
| 4,058,688 | A * | 11/1977 | Nishimura et al. | 381/372 |
| 4,097,689 | A * | 6/1978 | Yamada et al. | 381/310 |
| 4,278,852 | A * | 7/1981 | Gorike | 381/372 |
| 4,338,489 | A * | 7/1982 | Gorike | 381/117 |
| 4,654,898 | A * | 4/1987 | Ishikawa | 2/209 |
| 4,922,542 | A * | 5/1990 | Sapiejewski | 381/373 |
| 6,466,681 | B1 * | 10/2002 | Siska et al. | 381/372 |
| 6,856,690 | B1 * | 2/2005 | Skulley | 381/371 |
| 7,311,957 | B2 * | 12/2007 | Bargo, II | 428/74 |
| 7,466,838 | B1 * | 12/2008 | Moseley | 381/370 |
| 2003/0134553 | A1 * | 7/2003 | Sheffer | 442/120 |

FOREIGN PATENT DOCUMENTS

| | | |
|---|---|---|
| JP | 5-36991 | 5/1993 |
| JP | 10-32892 | 2/1998 |
| JP | 11-331972 | 11/1999 |
| JP | 2004-32645 | 1/2004 |

* cited by examiner

*Primary Examiner* — Curtis Kuntz
*Assistant Examiner* — Ryan Robinson
(74) *Attorney, Agent, or Firm* — Oblon, Spivak, McClelland, Maier & Neustadt, L.L.P.

(57) ABSTRACT

A headphone unit including a back housing provided at the rear of a driver unit and a baffle portion provided at the front thereof. In the headphone apparatus, the baffle portion, which is formed to surround a space except a front opening portion of a driver unit, and/or the back housing portion, which is formed to cover the back surface of the driver unit, are formed using the air-permeable porous material.

18 Claims, 5 Drawing Sheets

HEADPHONE DEVICE

TECHNICAL FIELD

The present invention relates to an improvement on a headphone apparatus, in which sound quality is improved, a feeling of pressure on an ear and a cooped-up feeling are alleviated, and a feeling of comfortableness is obtained when wearing the headphone apparatus.

BACKGROUND ART

A variety of headphone apparatuses of relatively high sound quality and of large size have been proposed; and typically, in order to generate an acoustic field space for naturally resonating in a back housing where a driver unit is housed, an headphone apparatus using a solid zelkova wood and the like are sold, however, the housing portion and ear pad portion thereof are large to cause an increase in weight.

FIG. 6 is a side sectional view showing a back housing portion used for a conventional headphone apparatus which is large and of high sound quality, shown in Patent Literature 1.

In FIG. 6, reference numeral 1 denotes an approximately circular or elliptical baffle board formed of material such as synthetic resin or wood through which no sound is transmitted.

A driver unit 5 is opposed to or fitted into a through-hole 4 made in the approximate center of this baffle board 1.

The driver unit 5 has a structure of an electrodynamic type in which a voice coil 5C fixed to a domed diaphragm 5A is driven between a magnet 5B and a concave yoke 5D, similarly to a typical loudspeaker.

A plurality of air ventilation holes 6A, 6B, . . . are made with the through-hole 4 made in the center of the baffle board 1; and a highly air-permeable ventilation member 9 made of sponge, unwoven fabric or the like is attached to each of the through-holes 6A and 6B.

A domed back housing 2 covers the back surface of the baffle board 1 and is integrated with the baffle board 1 to form a housing 3 as a baffle portion.

A ventilation hole 7 is made in the back surface (top) of the housing 2, and a ventilation member 9 is attached similarly to the ventilation holes 6 in the baffle board 1 to enhance the baffle effectiveness. Nonferrous metal, synthetic resin, solid zelkova that is a wooden material as described above or the like is selected for the back housing 2, and an acoustic field space is made large to improve sound quality.

On the front surface of the baffle board 1 is provided an ear pad 8 in which an approximately ring-shaped cushion member made of sponge or the like is surrounded by an outer skin 10 made of synthetic resin, leather, cloth, or the like.

[Patent Literature 1] Published Utility Model Application No. H5-36991 (FIG. 6)

DISCLOSURE OF THE INVENTION

In the headphone apparatus formed as described above, in order to secure the strength, in addition to the housing 3 a supporting member and the like which support a headband are formed of metal members and so the weight of the whole headphone apparatus becomes greater than is necessary.

When wearing such a large and heavy headphone apparatus on the head, there is a problem that heaviness and pressure are felt by the head and the ear, which intensifies a cooped-up feeling to cause an unpleasant wearing feeling.

Also, with a conventional structure, there is a problem that a typical cooped-up feeling of a headphone apparatus arises inevitably.

The present invention is made to eliminate the above problems and aims at obtaining a headphone apparatus in which an approximately cone-shaped air-permeable baffle portion having the baffle effectiveness is provided between a driver unit and an ear pad so as to remove a cooped-up feeling and to reduce resonance sharpness with obtaining light weight.

A second problem is dark noise originated from outside sound and the present invention is made to solve the problem and aims at obtaining a headphone apparatus in which a housing that houses a driver unit is formed of an air-permeable lightweight member to prevent outside sound from being dark noise (not to be muffled).

BEST MODE OF CARRYING OUT THE INVENTION

Figure 1:
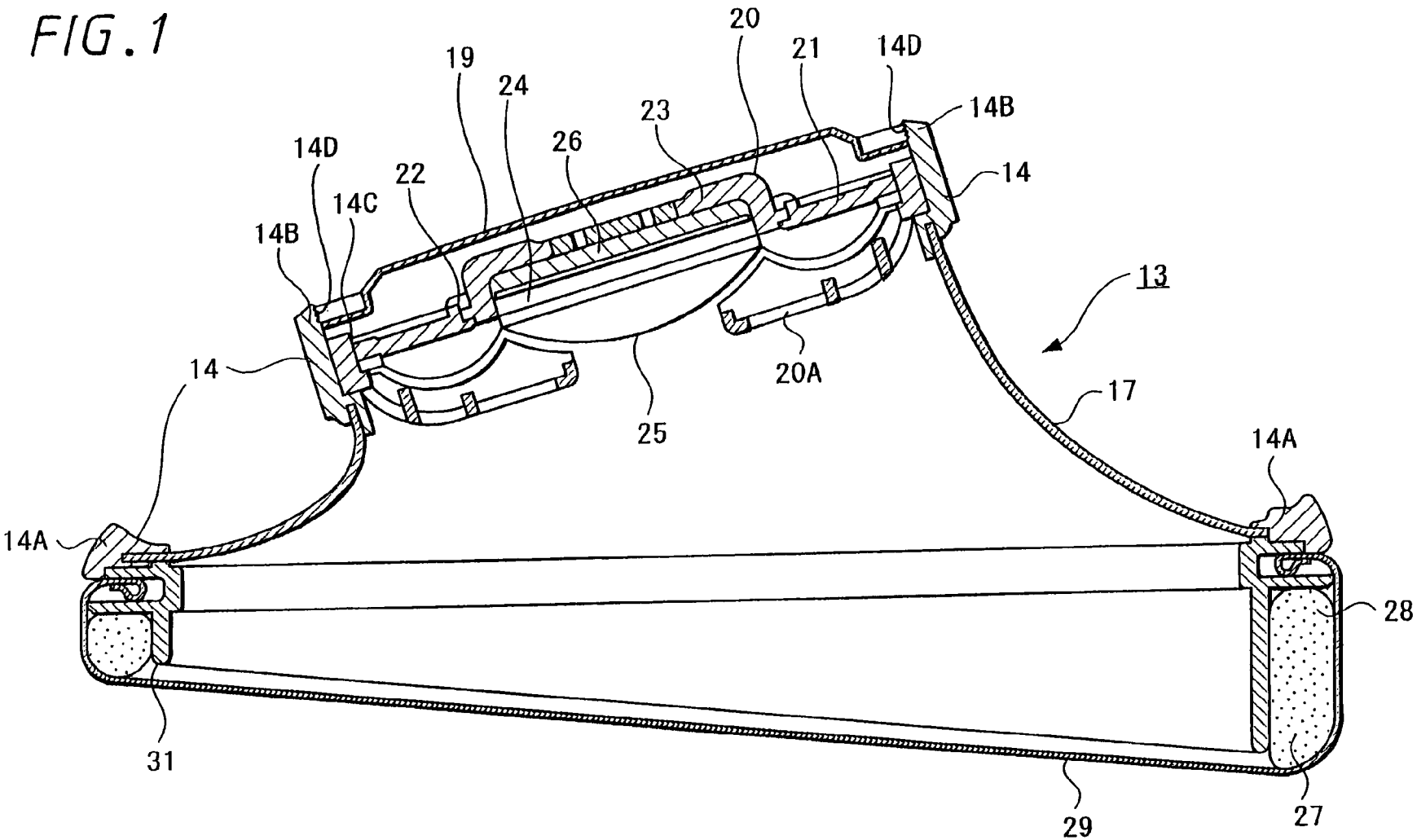
FIG. 1 is a side sectional view of a headphone unit used for a headphone apparatus of the present invention.
Figure 2B:
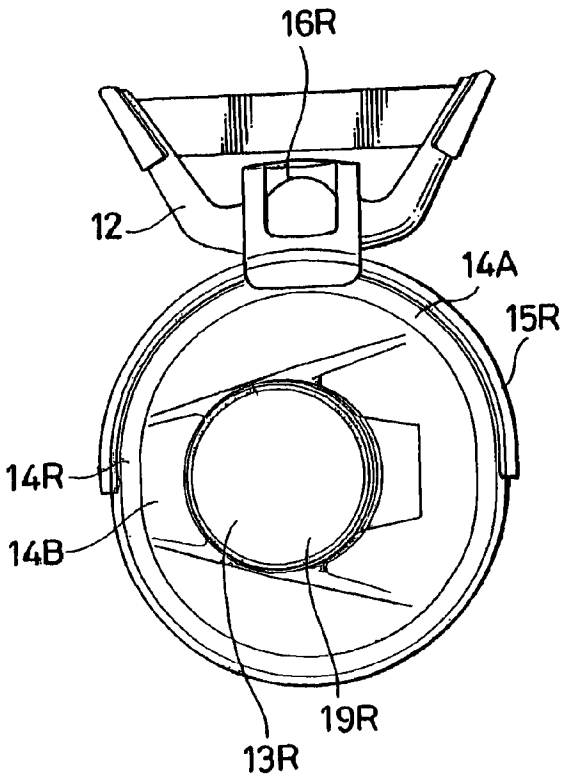
FIGS. 2A and 2B are front and side views of a headphone apparatus of the present invention.
Figure 2A:
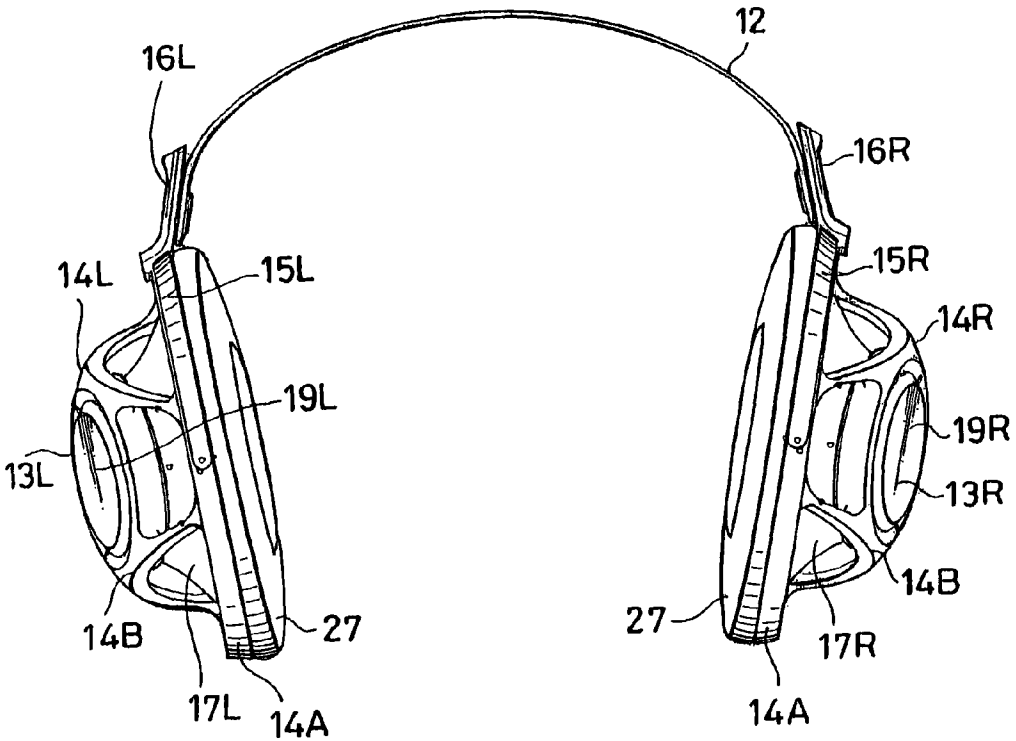
Figure 3A:
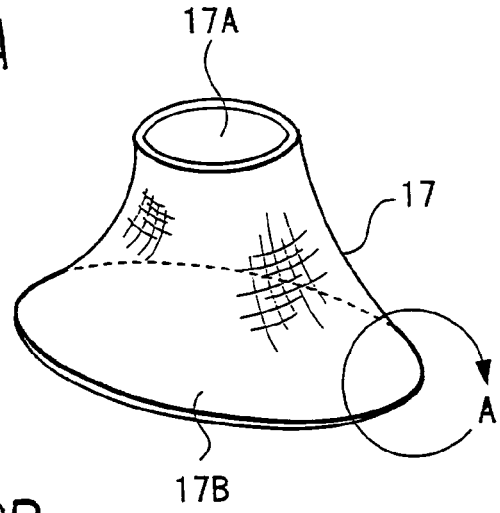
FIGS. 3A and 3B are a perspective view of a baffle portion and a side sectional view of a back housing, used for a headphone apparatus of the present invention.
Figure 3B:
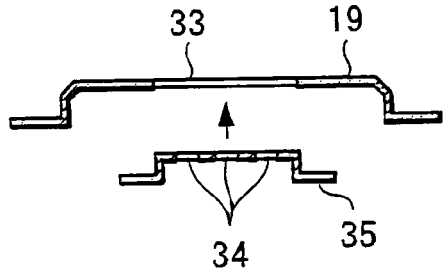
Figure 4A:
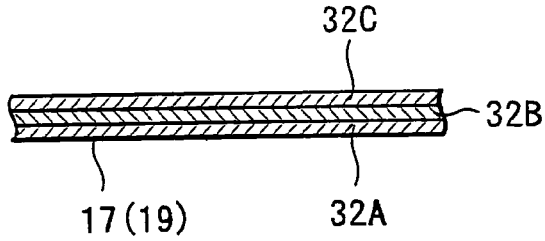
FIGS. 4A to 4C are enlarged views of a cross section of material, for explaining a porous material used for a baffle portion and a back housing in a headphone apparatus of the present invention.
Figure 4B:
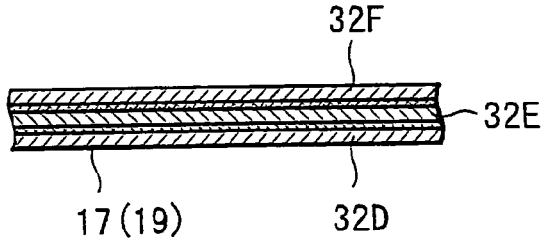
Figure 4C:
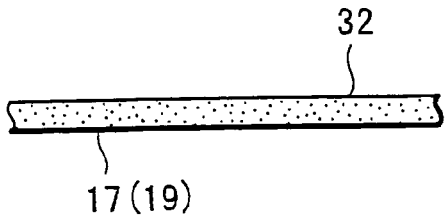

Hereinafter, an embodiment of the present invention will be described in detail with reference to FIGS. 1 to 4. FIG. 1 is a side sectional view of a housing portion which has a driver unit according to the present invention; FIGS. 2A and 2B are external views of a headphone apparatus according to the present invention; FIGS. 3A and 3B are a perspective view of a baffle portion and a side sectional view of a back housing, used for the present invention; and FIGS. 4A to 4C are cross-sectional views of a part A in FIG. 3A, for explaining a method of processing an air-permeable member.

Regarding FIGS. 1 to 4, prior to explaining FIG. 1, the whole structure of a headphone apparatus of the present invention is explained referring to FIGS. 2A and 2B.

FIGS. 2A and 2B show a front view and a right side view of a headphone apparatus, respectively. In FIGS. 2A and 2B, a headphone apparatus 11 includes a flexible lightweight headphone band 12 made of a metal such as duralumin or magnesium alloy, or made of a carbon composite material or the like, and left and right headphone units 13L and 13R each including a driver unit.

In the left and right headphone units 13L and 13R is included a driver unit, and the driver units are held in left and right frames 14L and 14R, each of which includes a bridge portion 14B made of a lightweight metal member such as titanium alloy or magnesium alloy formed like a bridge in a rim 14A; and the headphone band 12 includes approximately U-shaped left and right band adjustment portions 16L and 16R fixed to approximately semicircular left and right pendent frames 15L and 15R pivotably attached to the left and right frames 14L and 14R. Inside the left and right frames 14L and 14R are provided ear pads 27.

In FIG. 2A, reference numerals 17L and 17R denote cone-shaped left and right baffle portions described later on; in FIGS. 2A and 2B, reference numerals 19L and 19R denote left and right back housings similarly described later on.

Hereinafter, the left and right headphone units 13L and 13R of the present invention will be explained using FIGS. 1, 3 and 4.

In FIG. 1, in the left and right headphone units 13L and 13R (hereinafter called headphone units 13), a driver unit 20 constituting a loudspeaker is fitted into a through-hole 22 that is made in the center of a disk-like baffle board 21. The loudspeaker in the driver unit 20 has a structure of a typical dynamic type. In this driver unit 20, a reference numeral 23 denotes a yoke, 24 denotes a voice coil, 25 denotes a domed diaphragm and 26 denotes a disk-like magnet.

In frames 14 (14L and 14R), an arched bridge 14B is formed like a bridge to an annular-shaped rim 14A as shown in FIG. 1 and FIGS. 2A and 2B, using a lightweight alloy such as titanium alloy or magnesium alloy, and the baffle board 21 is fixed into a through-hole 14C made in the bridge 14B. In addition, a symbol 20A denotes a protector.

Behind the driver unit 20 is formed an approximately cap-like back housing 19 for maintaining a predetermined space between the driver unit and the baffle board 21. The back housing 19 is locked by a through-hole 14D made in the bridge 14B of the frame 14.

Between the bridge 14B of the frame 14 and the rim 14A of the frame 14 is provided a baffle portion 17 which is cone-shaped similarly to a diaphragm of a loudspeaker.

An ear pad 27 in which a cushion material 28 made of expandable synthetic resin, sponge or the like and covered with an outer skin 29 made of soft cloth, leather or the like has been formed into a ring shape and in a front-rear asymmetrical manner (in a horizontally asymmetrical manner in FIG. 1) is attached to the rim 14A of the frame 14 through an attachment frame 31 integrally formed with the rim 14A of the frame 14.

FIGS. 3A and 3B show a perspective view and a side sectional view of the baffle portion 17 and the back housing 19 in the above-described headphone unit 13.

The baffle portion 17 provided between the bridge 14B and the rim 14A of the frame 14 as shown in FIG. 1 is approximately formed into the shape of a cone with an air-permeable porous material 32 having a porous structure, as shown in FIG. 3A. Pulp, unwoven fabric of chemical fiber (Eltas Smash® produced by ASAHI KASEI FIBERS CORPORATION), cellulose based material or the like can be used as the porous material, for example.

FIGS. 4A to 4C show enlarged cross-sectional views of the part A in FIG. 3A in the thickness direction; and as shown in FIG. 4C, a kind of porous material 32 is selected from the above-described materials to be heated and pressed in a mold similar to the shape of FIG. 3A, and so the baffle portion 17 shown in FIG. 3A is molded.

An upper opening portion 17A of the cone-shaped baffle portion 17 shown in FIG. 3A is inserted and fixed in a groove portion in the bridge 14B of the frame 14 as shown in FIG. 1, and a lower opening portion 17B is inserted and fixed in a groove portion in the rim 14A of the frame 14.

FIG. 3B shows a modified example of the back housing 19 shown in FIG. 1, in which a through-hole 33 is made at the top of the back surface where the driver unit 20 in FIG. 1 is housed or a cap 35 provided with a large number of through-holes 34 is inserted and fixed in the through-hole 33. The back housing 19 is made of a porous material to be press-molded similarly to FIG. 1. A plurality of through-holes are provided as the through-holes 34 in the cap 35 to obtain a greater amount of airflow than that of the porous material. Further, other materials than a porous material, such as a predetermined air-impermeable synthetic resin or metal may also be selected for the cap 35.

Other methods of forming the above-described baffle portion 17 and back housing 19 are explained referring to FIGS. 4A and 4B.

FIGS. 4A and 4B are cases in which a plurality of porous materials are combined to form; in FIG. 4A, a composite sheet, in which on an air-permeable pulp 32A as a first layer of a porous material is bonded a nylon cloth 32C of a second porous material through an adhesive sheet 32B of an unwoven cloth provided with predetermined holes, is used to obtain the baffle portion 17 and the back housing 19 press-molded into predetermined shapes shown in FIGS. 3A and 3B.

The structure shown in FIG. 4B is a sheet in which on an air-permeable chemical fiber unwoven fabric 32D as a first layer is laminated an air-permeable cellulose or chemical fiber based unwoven fabric 32F as a second layer through an air-permeable double-faced adhesive sheet 32E, and the baffle portion 17 and the back housing portion 19 are formed by molding the sheet into a predetermined shape.

In the above described composite sheets, cloth-cloth and pulp-cloth are used as combinations between first and second layers, however, pulp-pulp, cloth-pulp combinations and the like can be used as the first and second layers to stabilize the shapes of the baffle portion 17 and the back housing 19.

According to the above-described structures of the back housing 19 and the baffle portion 17, since sound entered from the outside permeates into a space between the baffle board 21 and the back housing 19 where the driver unit 20 is housed without being shut out, sound from the outside can be prevented from being trapped inside the housing, such that clear sound which is not muffled can be emitted.

Further, the baffle portion 17 is made into a predetermined cone shape so that low sound is concentrated in the earhole, and characteristics in the low range can be set as desired by allowing air in the space surrounded by the baffle portion 17 to permeate from the outside to inside and from the inside to outside, which greatly improves low-range frequency characteristics together with the bass lens effectiveness to thereby obtain a headphone apparatus in which weight is reduced not to cause a feeling of heaviness and a feeling of pressure due to lateral pressure on the ear, when being worn on the ear.

Figure 5:
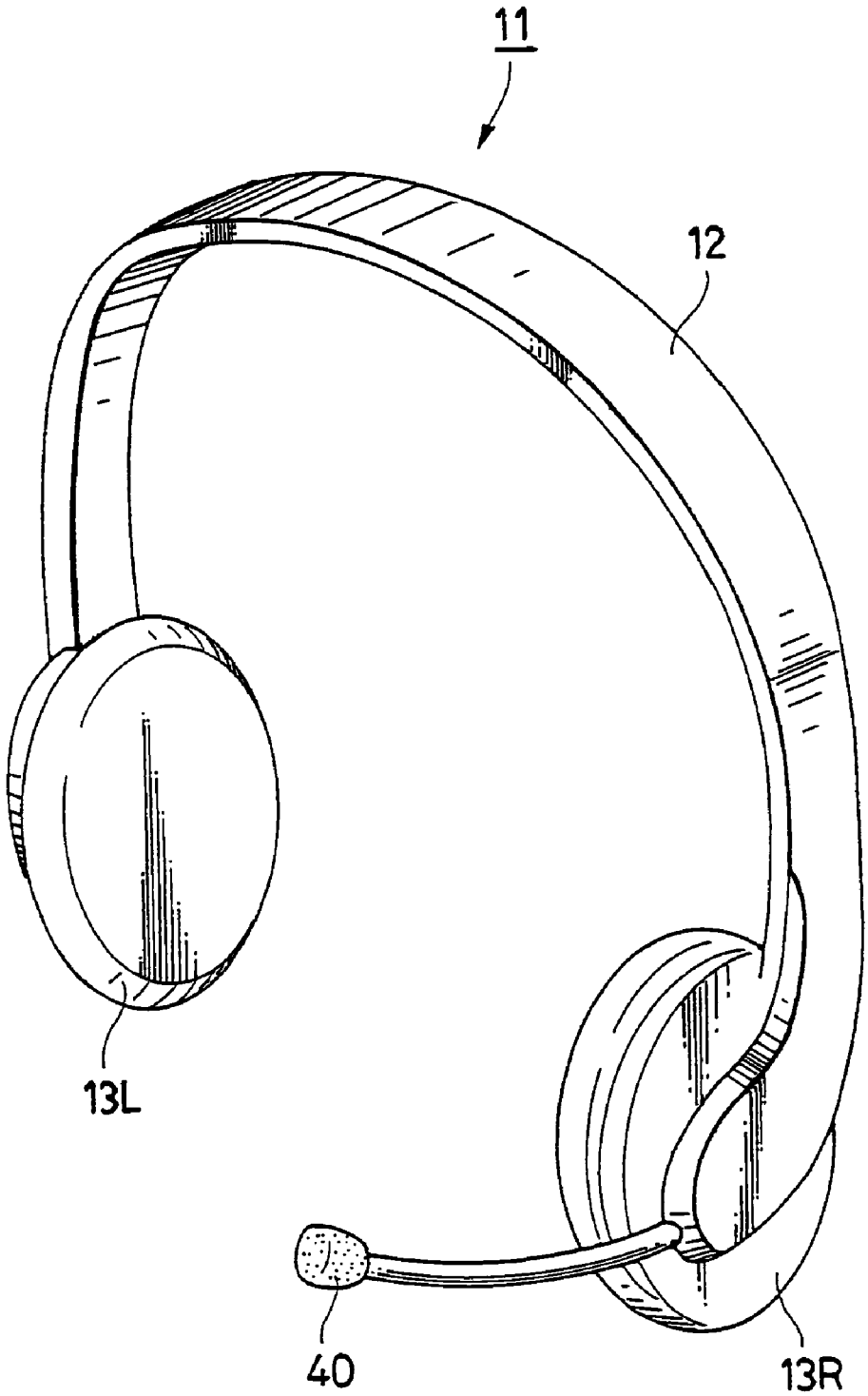
FIG. 5 is a perspective view showing another structure of a headphone apparatus of the present invention.
Figure 6:
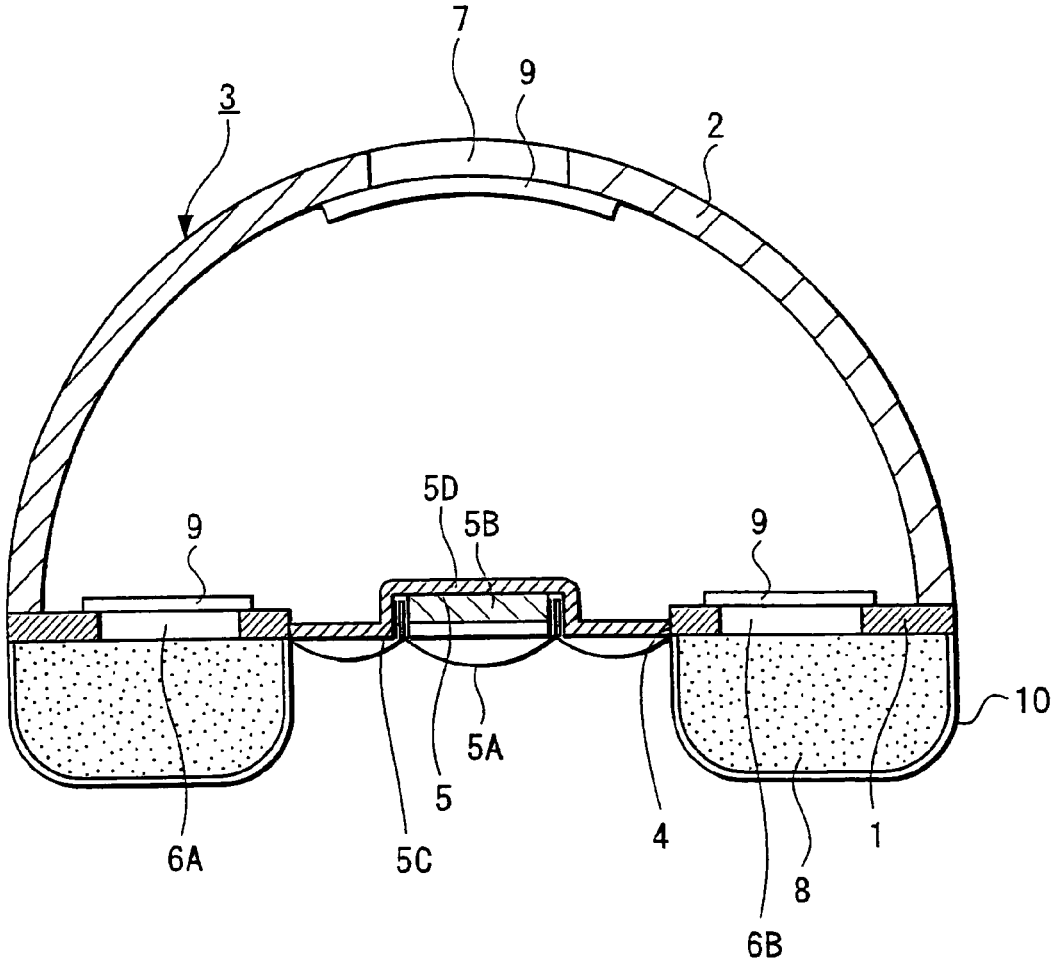
FIG. 6 is a side sectional view of a headphone unit used for a conventional headphone apparatus.

The present invention can be applied to a headset in which a microphone 40 is added to the above-described headphone apparatus, as shown in FIG. 5.

INDUSTRIAL APPLICABILITY

According to the present invention, a headphone apparatus and a microphone-attached headphone apparatus in which the baffle effectiveness can further be enhanced by means of the bass lens effectiveness are obtained by providing driver units at positions away from the positions of both ears.

The invention claimed is:

1. A headphone apparatus, comprising:

a baffle portion forming outer edges of the headphone apparatus and surrounding a space except a front opening portion of a driver unit, the baffle portion being formed of an air-permeable porous material such that air from outside the apparatus permeates through the material and external sound is prevented from being trapped interior to the baffle portion, degrading sound quality, wherein said baffle portion is approximately cone-shaped having a circular cross-section, and wherein said air-permeable porous material of the baffle portion comprises an unwoven fabric of chemical fiber.

2. The headphone apparatus according to claim 1, further comprising:

a back housing portion formed to cover a back surface of the driver unit, the back housing portion being formed of an air-permeable porous material such that external sound is prevented from being trapped interior to the back housing portion, degrading sound quality.

3. The headphone apparatus according to claim 2, wherein said air-permeable porous material of the back housing portion comprises an unwoven fabric of chemical fiber.

4. The headphone apparatus according to claim 2, wherein said air-permeable porous material of the back housing portion comprises a cellulose based material.

5. The headphone apparatus according to claim 1, wherein said driver unit is provided in a bridge portion shaped like an arch forming a bridge to a rim which forms a frame.

6. The headphone apparatus according to claim 1, wherein the cone shape of said baffle portion is asymmetrical with respect to an axis of the cone.

7. The headphone apparatus according to claim 3, wherein said unwoven fabric of chemical fiber of the back housing portion is combined with a porous material through an air-permeable adhesive layer to stabilize a shape of the fabric.

8. The headphone apparatus according to claim 4, wherein said cellulose based material of the back housing portion is combined with a porous material through an air-permeable adhesive layer to stabilize a shape of the cellulose based material.

9. The headphone apparatus according to claim 1, wherein a microphone device is attached to said headphone apparatus.

10. The headphone apparatus according to claim 2, wherein an opening is made in a back surface of said back housing portion.

11. The headphone apparatus according to claim 2, wherein the driver unit is provided in a bridge portion shaped like an arch forming a bridge to a rim which forms a frame.

12. The headphone apparatus according to claim 2, wherein a microphone device is attached to said headphone apparatus.

13. A headphone apparatus, comprising:

a baffle portion forming outer edges of the headphone apparatus and surrounding a space except a front opening portion of a driver unit, the baffle portion being formed of an air-permeable porous material such that air from outside the apparatus permeates through the material and external sound is prevented from being trapped interior to the baffle portion, degrading sound quality, wherein said baffle portion is approximately cone-shaped having a circular cross-section, and wherein said air-permeable porous material of the baffle portion comprises a cellulose based material.

14. The headphone apparatus according to claim 1, wherein said unwoven fabric of chemical fiber of the baffle portion is combined with a porous material through an air-permeable adhesive layer to stabilize a shape of the fabric.

15. The headphone apparatus according to claim 13, wherein said cellulose based material of the baffle portion is combined with a porous material through an air-permeable adhesive layer to stabilize a shape of the cellulose based material.

16. The headphone apparatus according to claim 2, wherein the back housing portion is an outermost surface of the headphone apparatus.

17. The headphone apparatus according to claim 1, wherein the baffle portion includes a first circular end, a second circular end having a larger diameter than the first end, and side portions connecting the first end to the second end.

18. The headphone apparatus according to claim 13, further comprising:

a back housing portion formed to cover a back surface of the driver unit, the back housing portion being formed of an air-permeable porous material such that external sound is prevented from being trapped interior to the back housing portion, degrading sound quality.

* * * * *